United States Patent [19]

Fuhrmeister

[11] 4,106,180

[45] Aug. 15, 1978

[54] METHOD AND APPARATUS FOR RIVETING

[75] Inventor: Ralph Fuhrmeister, Tarragindi, Australia

[73] Assignee: Furma Manufacturing Co. Pty. Ltd., Coopers Plains, Australia

[21] Appl. No.: 788,645

[22] Filed: Apr. 18, 1977

[30] Foreign Application Priority Data

Apr. 20, 1976 [AU] Australia ..... PC5632

[51] Int. Cl.[2] ..... B21J 15/04; B23P 11/00

[52] U.S. Cl. ..... 29/432.1; 227/54

[58] Field of Search ..... 29/432.1, 243.53, 243.54, 29/569; 227/21, 54, 77, 79, 59, 61, 51, 62

[56] References Cited

U.S. PATENT DOCUMENTS

| | | | |
|---|---|---|---|
| 890,965 | 6/1908 | Cordell | 227/54 |
| 1,156,013 | 10/1915 | Larsen | 227/54 |
| 3,022,687 | 2/1962 | Richards | 29/432.1 |
| 3,057,231 | 10/1962 | Ikelheimer | 227/54 |
| 3,687,349 | 8/1972 | Doring | 227/61 |

*Primary Examiner*—Milton S. Mehr

*Attorney, Agent, or Firm*—Haseltine, Lake, & Waters

[57] ABSTRACT

Sheet metal pieces are riveted together by punching a hole through the pieces with a rivet the shank of which is driven through them, into an oversize female die, and to a cutter, the pieces being deformed into the die, and the penetrating end of the rivet shank being divided into a number of sections by the cutter, which also spreads these sections apart, the diameter of the die being such that the spread sections of the divided rivet shank may be withdrawn.

3 Claims, 11 Drawing Figures

METHOD AND APPARATUS FOR RIVETING

BACKGROUND OF THE INVENTION

This invention relates to a method of and apparatus for riveting.

A riveting operation, such as the riveting together of two pieces of sheet metal, normally involves the steps of forming corresponding holes through the two metal pieces, inserting a rivet through the registering holes, and deforming the inserted end of the rivet.

Because of the operations involved, riveting is fairly slow, and in many cases more costly than, for example, spotwelding. Welding has certain disadvantages, particularly welding galvanized sheet steel, which destroys the galvanizing in the vicin;ty of the weld, and also welding aluminium, which requires special techniques and affects the strength of the welded aluminium.

SUMMARY OF THE INVENTION

The general object of the present invention is to provide a method and apparatus whereby riveting may be very quickly and economically carried out. Another object achievable in certain embodiments of the invention is to provide apparatus whereby a very strong joint may be effected, using two or more rivets driven simultaneously.

With the foregoing and other objects in view, the invention resides broadly, in one aspect, in a method of riveting sheet metal pieces including the steps of driving a rivet to deform parts of the sheet metal pieces into an oversize female die; further driving the rivet through the female die and to a cutter to cause the rivet to punch a hole through the sheet metal pieces, to cause the penetrating end of the rivet to be cut by the cutter into a number of sections, and to cause the said sections to be spread apart by the cutter.

In another aspect, the invention resides broadly in apparatus for carrying out the said method including a frame, a female die on the frame, a cutter within the die, a rivet carrier mounted on the frame for supporting a rivet, a rivet driver for advancing the rivet shank first into the die to deform parts of sheet metal pieces, superimposed on the die, into the die and to the cutter, and to punch a hole through the sheet metal pieces; the cutter being adapted to cut the penetrating end of the rivet into sections and to spread the said sections.

BRIEF DESCRIPTION OF THE DRAWINGS

In order that the invention may be readily understood and carried into practical effect, reference is now made to the accompanying drawings, wherein.

DETAILED DESCRIPTION OF THE PREFERRED EMBODIMENT OF THE INVENTION

Figure 1:
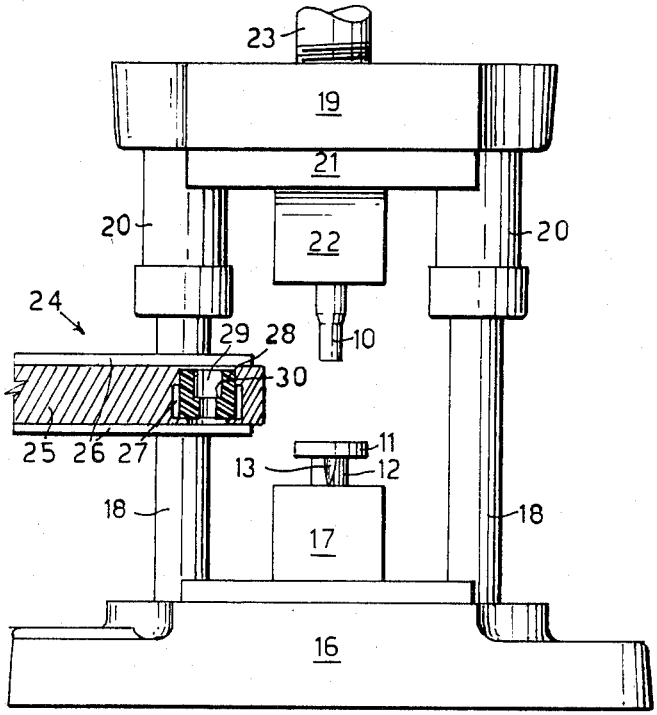
FIG. 1 is a partly broken-away front elevation of a simple riveting apparatus according to the invention.
Figure 2:
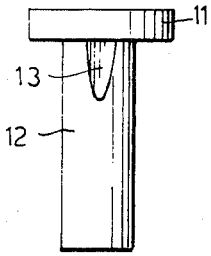
FIG. 2 is a front elevation, to larger scale, of the die and cutter assembly of the apparatus.
Figure 3:
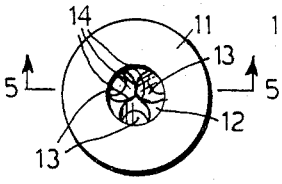
FIG. 3 is a plan view of the assembly shown in FIG. 2.
Figure 4:
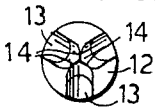
FIG. 4 is a plan view of the cutter of the assembly.
Figure 5:
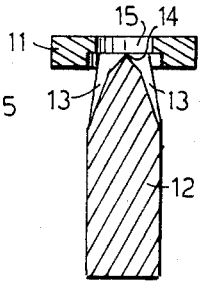
FIG. 5 is a section along line 5—5 in FIG. 3.

According to the invention, riveting is effected principally by rivet drivers 10, dies 11 and cutters 12, one set of these parts being used in the simple apparatus shown in FIG. 1, and two sets being used in the apparatus shown in FIG. 2. In each case, the cutter consists of a cylindrical metal member formed with three equidistantly spaced slug outlet grooves 13 decreasing in depth from top to bottom, the grooves leading down from between three equiangularly spaced radial cutting edges 14 at the top of the cutter.

The die 11 in each case consists of an annular member, its axial opening 15 being increased in diameter at the bottom to receive the top of the cutter 12, on which the die is force-fitted.

The apparatus shown in FIG. 1 includes a cast base 16 on which is fixed a block 17 which is bored from the top to receive the lower part of the cutter 12, the lower ends of the slug outlet grooves 13 being above the top of the block.

Two guide rods 18 extend vertically from the rear of the base 15. A cross-head 19 has a pair of sleeves 20 slidable on the guide rods so that the cross-head may be raised and lowered in parallelism. Below the cross-head there is fixed a plate 21 and below it a block 22 which is bored from below to receive the upper part of the rivet driver 10, of round section, its lower part being somewhat reduced in diameter, the parts being so arranged that the rivet driver is coaxial with the die 11 and cutter 12.

The apparatus may be applied to an existing tool press (not shown) of any suitable type, the base 16 being bolted to the table of the tool press, the hydraulically operated plunger 23 of which is engaged in a tapped hole formed in a cross-head 19 coaxially with the rivet driver 10.

Sheet metal articles to be riveted may be located on the die 11, and a rivet brought to appropriate position coaxially above the die and cutter and below the rivet driver by means of a rivet carrier 24. The rivet carrier includes a metal block 25 horizontally slidable in guides 26 and formed with a vertical hole 27 to receive a cylindrical rivet guide 28 of resiliently deformable material, the hole 27 being of reduced diameter at the bottom to retain the rivet guide 28, and of increased diameter for some distance thereabove to permit lateral expansion of the lower part of the rivet guide. The rivet guide is formed with an axial passage 29, the lower part of which is reduced in diameter, forming an internal annular shoulder 30. When the rivet carrier is moved slidably clear of the rivet driver 10, as shown, a rivet may be fed manually or otherwise into the axial passage 29, its head being supported by the shoulder 30, its shank extending downwardly. The rivet carier may then be moved slidably to bring the rivet between and coaxial with the rivet driver 10 and the die 11 and cutter 12, and over sheet metal articles to be riveted and positioned on the die 11.

Figure 6:
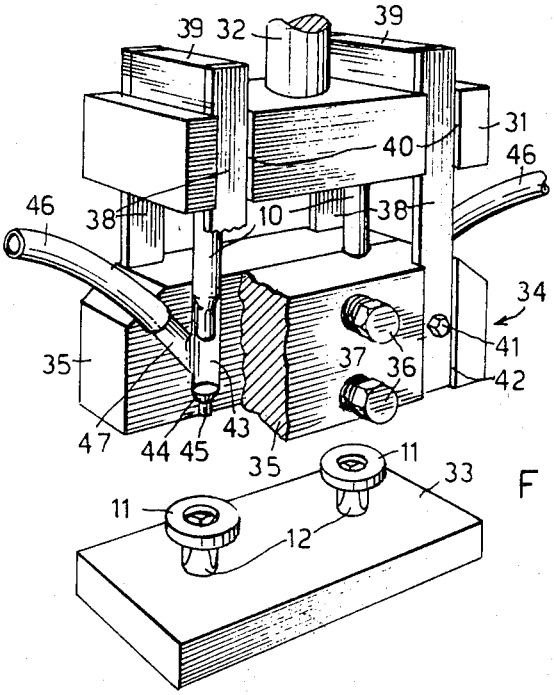
FIG. 6 is a partly broken-away perspective view of riveting apparatus according to an alternative embodiment of the invention, for carrying out two riveting operations simultaneously.

In the apparatus shown in FIG. 6, two parallel rivet drivers 10 extend downwardly from a cross-head 31 which has a central aperture in which the lower end of the piston 32 of a hydraulic cylinder is secured. A base block 33 is formed with two parallel holes to receive the lower parts of a pair of cutters 12 with dies 11, all as before described, the parts being so made and arranged that the two rivet drivers 10 are coaxial with the two cutters 12 and dies 11.

A rivet carrier 34 is suspended below the cross-head 31, the rivet carrier consisting of two similar but oppositely arranged blocks 35 held together in spring-loaded manner by a pair of bolts 36 passing through registering holes in the two blocks and engaged by nuts (not shown), helical compression springs 37 being interposed between the heads of the bolts and the near block, similar springs being similarly fitted between the nuts and the other block. The rivet carrier is suspended from the cross-head 31 by two pairs of leaf springs 38, those of each pair being secured at their tops to the ends of a cross-member 39 positioned over the cross-member, the leaf springs passing slidably down through vertical grooves 40 in the cross-head and being fixed, by bolts 41, in corresponding grooves 42 in the two blocks 35 of the rivet carrier 34.

Each of the rivet drivers 10 is slidable in a hole 43 through the rivet carrier, the hole being formed half in one block 35 and half in the other. The bottom of each hole 43 is reduced in diameter to form an annular internal shoulder 44. Rivets 45 may be fed into both of the holes 43 by way of flexible hoses 46 leading into oblique passages 47, each formed half in one block 35 and half in the other, the oblique passages 47 leading into the holes 43. The rivets may be delivered one at a time to each of the hoses 46 from any known type of feed device and propelled through the hose pneumatically, each rivet in turn coming to rest with its head supported by the shoulder 44. Sheet metal pieces to be riveted may be placed on the two dies 11 after which the cross-head 31 is depressed hydraulically. The rivet carrier 34 is brought down on the sheet metal pieces, and as the cross-head 31 continues its descent, the rivet drivers are simultaneously brought down onto the heads of the rivets 45.

Figure 7:
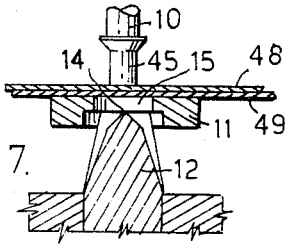
FIGS. 7, 8, 9 and 10 are sectional views showing the stages in a riveting operation according to the invention.
Figure 8:
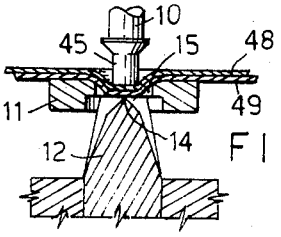

The riveting action, in either of the devices illustrated, is shown in sequence in FIGS. 7 to 10. As shown in FIG. 7, the two sheet metal pieces 48 and 49 are resting on a die, and a rivet 45 is brought down on the upper piece 48 by the rivet driver 10, the rivet guide 28 of FIG. 1 or the rivet carrier of FIG. 6, being omitted from the drawings. The axial opening 15 of the die 11 is of greater diameter than the shank of the rivet 45, and so. with further descent of the rivet, the superimposed sheet metal pieces 48 and 49 are pressed down into this opening 15, as shown in FIG. 8, the bottom sheet metal piece being pressed down onto the radiating cutting edges 14 of the cutter.

Figure 9:
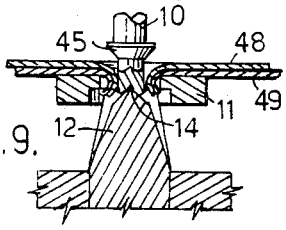
Figure 10:
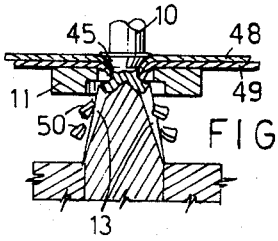
Figure 11:
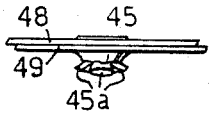
FIG. 11 is a side elevation of a riveted joint made according to the invention.

As shown in FIG. 9, with further depression of the rivet driver 10, the rivet causes the sheet metal pieces 48 and 49 to be cut by the cutting edges 14, and the rivet shank punches a hole through the sheet metal and is itself brought down onto the cutting edges 14. A Y-shaped cut is formed from the bottom of the rivet shank, the sheet metal immediately outwards of the rivet shank being bent outwardly. With the further descent of the rivet driver, as shown in FIG. 10, the Y-shaped cut from the bottom of the rivet shank is deepened, the three sections into which the bottom end of the rivet shank is divided are bent outwardly, and the bent over sheet metal pieces, or most of them, are broken off to be discharged as slugs 50 through the slug outlet grooves 13. The head of the rivet at this stage is pressed into the depression formed in the superimposed sheet metal pieces 48 and 49, and is thus substantially countersunk. FIG. 11 shows the side elevational appearance of the riveted connection, with the rivet 45 substantially countersunk, and with the three divided sections of the rivet shank bent outwardly as indicated at 45*a*. The diameter of the axial opening 15 of the die is sufficiently large to permit the outwardly bent parts 45 to be easily withdrawn from the die when the riveted pieces are lifted from the apparatus.

The apparatus may be modified to drive simultaneously three or more rivets, and therefore will enable riveted connections to be made much more quickly and economically than has been the case with apparatus hitherto used. At each riveted joint, the rivet shank passes very tightly through the holes it has formed through the sheet metal pieces, and this, with the interengagement of coned sections of the two sheet metal pieces will ensure that the connection is particularly strong.

I claim:

1. A method of riveting metal pieces including the steps of:

driving a rivet to deform parts of said pieces into a female die having a greater diameter than a shank portion of the rivet for engagement of the pieces with a cutter in the die;

continuing the forward movement of the rivet through the die causing the cutter to cut a plurality of cuts radiating from a point through the pieces; and further driving the rivet and punching a hole centered on said point through the pieces with the radiating cuts therein for urging the penetrating end of the rivet shank to be cut into a number of sections by the cutter, and causing said sections to be spread apart by the cutter.

2. An apparatus for riveting metal pieces initially superimposed with respect to a die including:

a frame;

a female die on the frame;

a cutter disposed within the die;

a rivet carrier mounted on the frame to support a rivet substantially coaxially with respect to the die;

a rivet driver for urging a rivet shank into the die, said die having an opening greater than the diameter of the shank and of a depth so that the rivet shank causes deformation of parts of the metal pieces in said die, and engagement of the cutter with said deformed pieces;

the cutter being recessed in said die for engagement by the deformed parts of the metal pieces, to thereby cut a plurality of cuts radiating from a point through the metal pieces by said cutter engaging said deformed parts, whereafter the rivet shank punches a hole through the now cut parts and the penetrating end of the rivet shank is cut into sections and said shank sections are spread.

3. An apparatus according to claim 2 wherein:

the cutter is formed at the end nearer to the rivet driver with a number of equiangularly spaced radial cutting edges, and having passages leading in a direction away from the rivet driver, from between each pair of succeeding cutting edges, and being adapted to discharge slugs detached from the riveted metal pieces.

* * * * *